United States Patent [19]

Fridh et al.

[11] Patent Number: 4,922,677

[45] Date of Patent: May 8, 1990

[54] BOARD PARTICULARLY FOR USE BY SUSPENDED CEILINGS

[75] Inventors: Lars G. Fridh, Malmö , Sweden; Benni Madsen, Kalundborg; Vagn N. Rasmussen, Bjaeverskov, both of Denmark

[73] Assignee: Gyproc AB, Malmo, Sweden

[21] Appl. No.: 338,549

[22] Filed: Apr. 14, 1989

Related U.S. Application Data

[63] Continuation of Ser. No. 18,502, Feb. 25, 1987, abandoned.

[30] Foreign Application Priority Data

Feb. 27, 1986 [DK] Denmark ..... 904/86

[51] Int. Cl.[5] ..... E04B 5/57

[52] U.S. Cl. ..... 52/486; 52/489; 52/763

[58] Field of Search ..... 52/481, 484, 486, 488, 52/489, 483, 496, 592, 763

[56] References Cited

U.S. PATENT DOCUMENTS

| | | | |
|---|---|---|---|
| 2,009,512 | 7/1935 | Offutt et al. | 52/489 X |
| 2,073,036 | 3/1937 | Voigt | 52/486 |
| 2,218,965 | 10/1940 | Young et al. | 52/484 X |
| 2,250,411 | 7/1941 | Baker | 52/486 |
| 2,584,194 | 2/1952 | Drury | 52/489 X |
| 3,049,204 | 8/1962 | Sorenson | 52/484 X |
| 3,332,194 | 7/1967 | Jack | 52/763 X |
| 3,900,997 | 8/1975 | Ollinger et al. | 52/763 |
| 4,157,000 | 6/1979 | Sutter | 52/489 |
| 4,255,910 | 3/1981 | Wendt | 52/489 X |
| 4,628,656 | 12/1986 | Menchetti et al. | 52/489 X |

FOREIGN PATENT DOCUMENTS

| | | |
|---|---|---|
| 813155 | 5/1959 | United Kingdom . |
| 1159611 | 5/1966 | United Kingdom . |
| 1277923 | 6/1972 | United Kingdom . |
| 1284308 | 8/1972 | United Kingdom . |
| 2081332 | 2/1982 | United Kingdom . |

*Primary Examiner*—Richard E. Chilcot, Jr.
*Attorney, Agent, or Firm*—Darby & Darby

[57] ABSTRACT

In order to be able to mount a suspended ceiling in places where the space between the ceiling and the overlying structure exceeds 40 mm there is according to the invention used a generally known metal suspension element (2, 3) with a T-iron (4,5).

On these T-irons (4,5) there are mounted plaster boards (6) in that on the back of the boards there are glued two metal strips (7,8), i.e. one with a backwardly bent edge (8) overlapping one of the flanges (5) and a metal strip (7) abutting on the flange (5) in the mounted position of the board. It is thereby possible to place the boards loosely and to take them down according to requirements without any need of tools. The structure will allow the mounting of an additional insulation layer on top of the boards (6). At the same time the structure will appear as plane ceiling surface i.e. with concealed support profiles (4,5). This simplifies maintenance.

With a view to being able to stack the boards (6) the strips (7,8) are so short that the strips are clear of each other and the boards, back to back, are turned 90° in relation to each other since the strips will then support the boards (6) evenly.

6 Claims, 3 Drawing Sheets

BOARD PARTICULARLY FOR USE BY SUSPENDED CEILINGS

Figure 1:
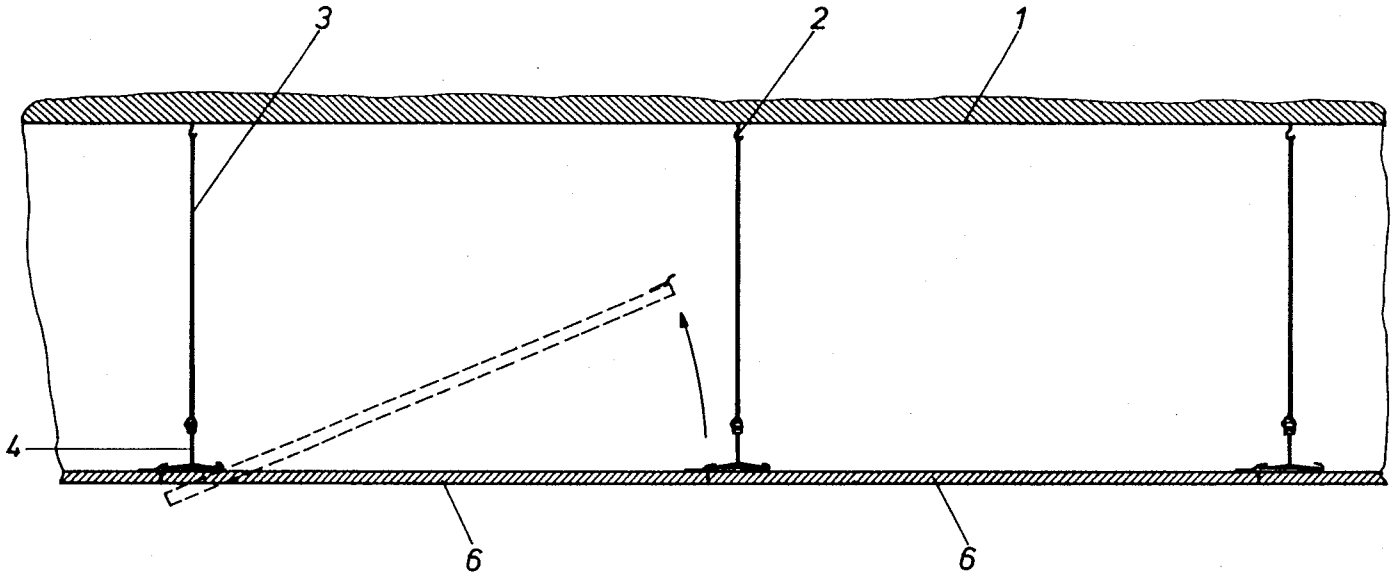

This is a continuation of application Ser. No. 018,502, filed Feb. 25, 1987, now abandoned.

The invention relates to a board, particularly of plaster, of rectangular shape particularly for use by suspended ceilings where the board is adapted to be secured to suspension elements the lower part of which is made up of profiles, preferably of metal, having horizontal protruding side flanges, said profiles being suspended in parallel and at intervals corresponding to the width of the board, and where on the back of the board parallel to one side edge of the board there is secured a first strip, preferably of metal, which partly extends a distance away from the back corresponding to the thickness of said side flanges and partly a short distance beyond said one side edge of the board, said first strip being designed to overlap one of the side flanges of a profile.

A suspended ceiling of this kind is described in British patent specification no. 1,159,611 where the construction consists in mounting the boards on suspended horizontal steel beams in that the boards along each of the two marginal edges have U-shaped metal clips where one side of the U's is seated in channels cut in the back of the board in such a manner that the other side of the U's can overlap side flanges of t he profiles. This structure is advantageous in that the profiles after the completed mounting of the boards are concealed since they are completely covered by the edges of the boards; the structure, however, has the disadvantage that it is difficult to mount the last row of boards by a suspended ceiling as it is then no longer possible to reach to the back of the boards.

The structure is not very advantageous either in cases where there may later be a need for having to reach over the suspended ceiling boards to make installation work or similar work. If such work is to be made the boards will have to be removed with the risk of causing damage to them since they are not particularly resistant to deformations or bendings.

Finally, the fact that channels for accomodating the U-shaped metal clips have to be out in the back of the boards will make the structure more expensive.

In order to remedy these deficiencies there may be used a suspension element comprising suspended supporting profiles with side flanges on which the boards may rest loosely supported along the side and end edges of the boards. It will thus be possible to lift up the individual boards and, if desired, take them down whereafter they may easily be mounted again without any risk of damage thereto. This suspension element, however, is not concealed since the flanges on which the boards rest protrude down below the boards along the adjacent sides. Later maintenance among other things by painting is thus made more difficult.

It is the object of the invention to remedy this deficiency by the known suspended ceilings and this is achieved by means of the board according to the invention which is characteristic in that on its back the board has a second strip, preferably of metal, which is bent backwards for forming a groove for receiving a second side flange of an adjacent profile at a distance from said one side edge of the board corresponding to the entire flange width of the profile.

By means of such boards it is possible by first tipping the boards to take a slanting position where the side edges are kept horizontal to edge said one side edge of the board up between two profiles whereafter it is possible easily and effortlessly to hook the groove-forming strip of the boards on the side flange of one of the profiles as a hook, and the strip secured by the said one side edge will by its protruding part abut on the upper side of the upper side of the other profile when the board is lowered to take a horizontal position. It is thereby possible later to remove each individual board by tipping same around one of the strips without any use of tools and without any risk of damaging the boards. There is moreover the additional advantage that the suspension itself will be concealed by the boards so that the ceiling appears as an unbroken ceiling surface which can be maintained.

If the board or the boards are made of plaster, the strips of metal and suspension of steel being socalled class A materials, the ceiling may immediately be accepted for a suspended ceiling where the distance to structures above exceeds 40 mm.

Finally it is advantageous as disclosed in claim 2 to glue the strips on to the boards as the glue will adhere to the back of the board and be quite concealed.

If the boards are square as disclosed in claim 3, it is advantageous to let the two strips have a limited length whereby it is possible to stack and transport the boards as by turning the boards 90° with the strip sides facing each other, the boards will be supported along all four side edges thereby preventing them from cracking.

Figure 2:
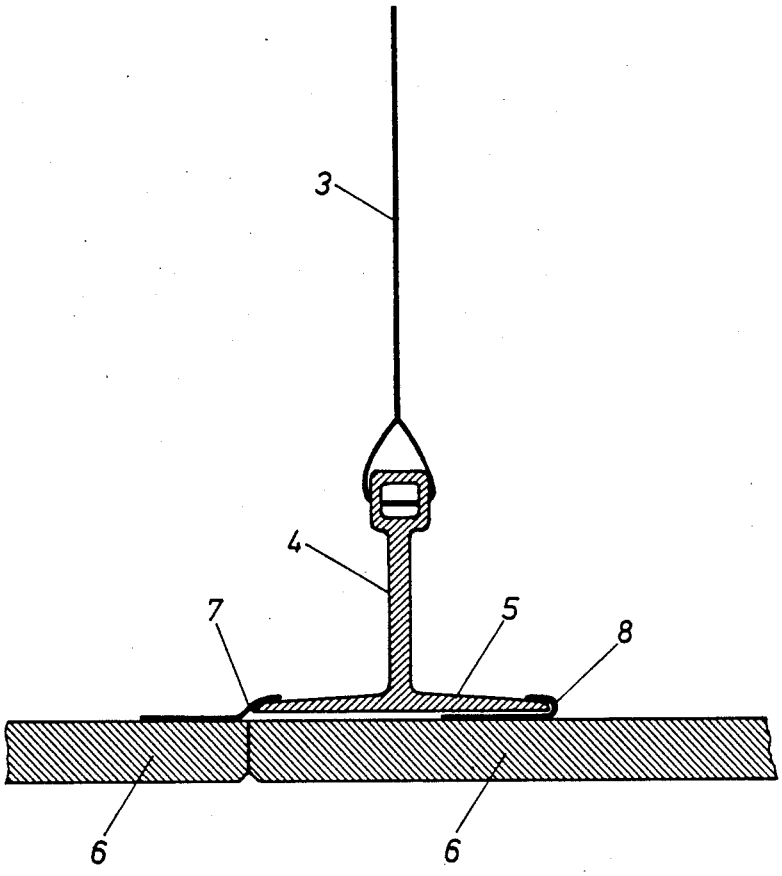
Figure 3:
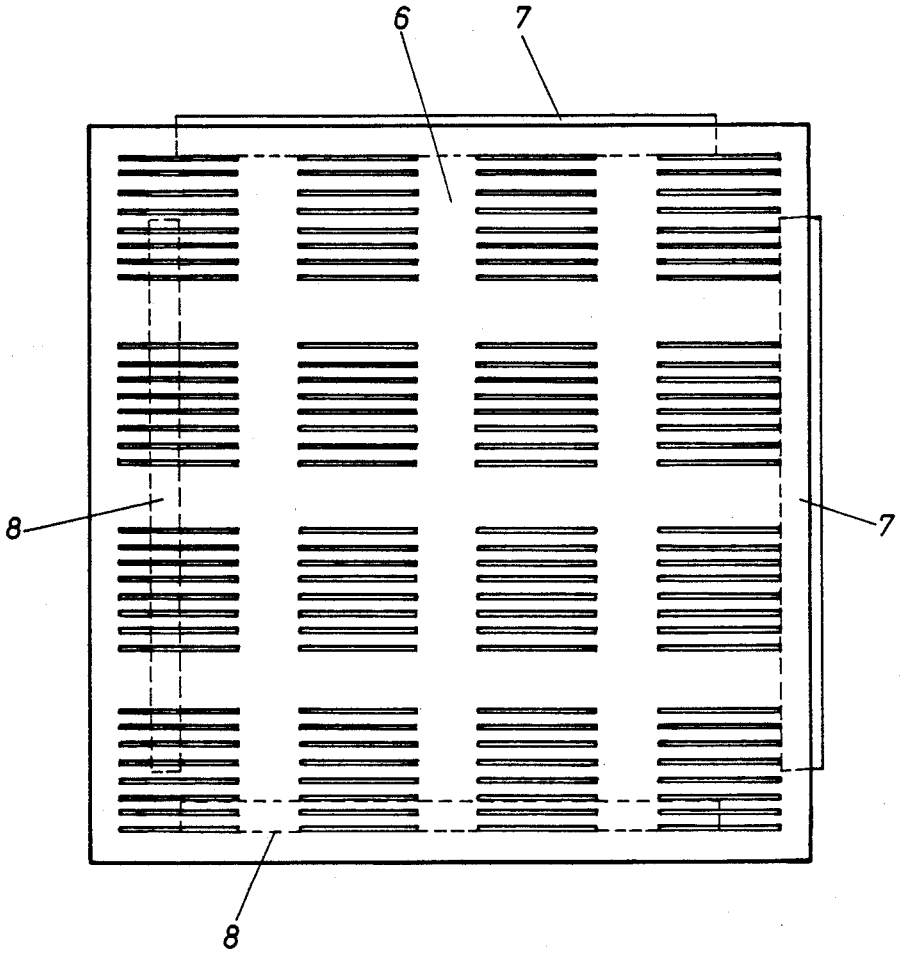

The invention will be further described in the following with reference to the drawing wherein FIG. 1 shows a sectional view of a ceiling structure with a suspended ceiling, FIG. 2 shows an enlarged section of a joint, and FIG. 3 shows a top view of a stack of boards.

FIG. 1 shows an example of a preferred embodiment of a suspended ceiling. The basis may be an existing ceiling 1 or a similar construction unit. In this ceiling or unit there is secured after measuring a number of hooks 2 wherein a generally known adjustable suspension 3 may be suspended. In these suspensions 3 there are secured profiles 4 which may be a T-iron as shown in FIG. 2. The T-iron has a vertical body 4 and horizontal side flanges 5. In the vertical part of the iron there are holes for the suspension 3. The suspension must be mounted in such a manner that the profiles 4 are arranged in parallel and at intervals corresponding to the boards 6 which are to be suspended. It is moreover important that the suspension is adjusted in such a manner that the side flanges 5 are on the same level.

The boards 6 which may be plaster boards can have holes or slits as shown in FIG. 3. This contributes to achieving good acoustics and boards of this type are normally termed baffle boards. They have rectangular shape and their lower side edge may be bevelled as appears from FIG. 2.

On the back of the boards 6 there are glued two strips, preferably of metal, having different sectional shape as shown in FIG. 2. The outer strip 7 is secured close to one of the side edges of the board 6 so that the bent piece protrudes beyond the board. The bend itself is such that the strip abuts on the upper side of the side flange so that the back of the board is clear of the underside of the flange as shown in FIG. 2.

The other strip 8 is placed a distance within the board 6 corresponding to the full flange width 5 of the profile 4. The strip 8 is bent as shown in FIG. 2 thus producing a groove for accomodating a side flange 5 so as to form a hinge-like joint on which the board 6 may be tipped as shown by the dashed line in FIG. 1.

The board 6 can now be placed in the suspension in that the boards are one by one pushed over the profile from above until a side flange 5 enters the groove of the strip 8. Then the boards may slide down until the strip 7 abuts on a side flange 5 of an adjacent profile. The process is continued until the entire ceiling is mounted. As the boards loosely abuts on the side flanges 5, they can be lifted and be taken down as desired without any use of tools.

The strips 7,8 are preferably glued to the boards but they can naturally be secured in some other way for example by forming an integral part of the surface cover.

The length of the strips 7,8 appears from FIG. 3 and is such that the strips are clear of each other when the boards are substantially square and are placed on top of each other with the strips facing each other and the boards turned 90° in relation to each other. In this manner the strips will support the overlying board along all four sides and thus prevent the boards from cracking or being bent.

Although the specification describes boards with plaster, it is within the scope of the invention to replace the plaster with some other filling material since the suspension may advantageously be used by boards made of other materials.

It is possible to glue a not shown insulating layer of mineral wool onto the back of the boards and this insulating layer may be placed as the ceiling is mounted. This contributes to optimum insulation and sound absorption.

What is claimed:

1. A suspended ceiling arrangement for holding a plurality of adjacent panels having first and second side edges in a side by side relationship from a plurality of substantially parallel suspension elements of the type having a substantially T-shaped configuration with a cross member having first and second edges, the suspension elements being spaced apart by approximately the width of a panel between its first and second side edges comprising:

a first and a second hanging strip for mounting on the upper surface of each panel which is to be suspended adjacent a corresponding first and second side edge of adjacent panels, said first side edge of a panel completely overlying the cross member of a first suspension element and said second side edge of the panel lying adjacent to but spaced away from the second edge of a second suspension element adjacent the panel second side edge, the first hanging strip on said panel being adjacent the first side edge thereof and lying completely inwardly of said panel first side edge and having a hook shaped end adapted to slidably receive and fit over only the first suspension element cross member first edge to support the panel first side edge and to form a hinge type joint allowing rotation and motion of the panel on said first suspension element cross member, the second hanging strip on said panel extending beyond the second side edge of the panel and having a raised lip portion to overlie only the top of the second edge of the cross member of said adjacent second suspension element and to rest thereon to support the panel second side edge, the second side edge of the panel being spaced away from the second edge of the cross member of said second suspension element, removal of a panel being accomplished by pushing upwardly of the second side edge thereof to lift the raised lip of the second hanging strip upwardly and off of the second edge of said adjacent second suspension element cross member and to rotate the panel with its second side edge clearing the second edge of the second suspension element about the hook part of the first hanging strip until the first hanging strip becomes disengaged from the first suspension element cross member first edge.

2. A suspended cylinder arrangement as set forth in claim 1 wherein each of said hanging strips is elongated and extends for substantial part of the length of a said panel.

3. A suspended ceiling arrangement according to claim 1, wherein said first and second strips are permanently attached to the board.

4. A suspended ceiling arrangement according to claim 1, wherein said first and second strips are glued to the board.

5. A suspended ceiling arrangement according to claim 1, wherein the length of each strip is shorter than the distance between the strips.

6. A suspended ceiling arrangement according to claim 1, whereby said first and second strips serve as a reinforcements of the board.

* * * * *